US008666268B2

(12) United States Patent
Watanabe et al.

(10) Patent No.: US 8,666,268 B2
(45) Date of Patent: Mar. 4, 2014

(54) FIXING DEVICE, IMAGE FORMING APPARATUS AND HEAT GENERATING ROTATIONAL BODY

(75) Inventors: Isao Watanabe, Toyohashi (JP); Yasuhiro Ishihara, Toyohashi (JP); Toshiaki Tanaka, Toyokawa (JP); Kosuke Sasaki, Toyokawa (JP); Naoki Ohashi, Toyokawa (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 233 days.

(21) Appl. No.: 13/110,057

(22) Filed: May 18, 2011

(65) Prior Publication Data

US 2011/0293297 A1 Dec. 1, 2011

(30) Foreign Application Priority Data

May 27, 2010 (JP) ..... 2010-121581

(51) Int. Cl.
*G03G 15/20* (2006.01)

(52) U.S. Cl.
USPC ..... 399/33; 399/67; 399/122; 399/322; 219/216; 219/544

(58) Field of Classification Search
USPC ..... 399/33, 67, 69, 90, 122, 320–322, 399/328–331; 219/216, 543, 544, 469
See application file for complete search history.

(56) References Cited

U.S. PATENT DOCUMENTS 5,115,279 A * 5/1992 Nishikawa et al. ..... 399/331
5,869,808 A * 2/1999 Hyllberg ..... 219/216
6,096,995 A * 8/2000 Toyota et al. ..... 219/216

(Continued)

FOREIGN PATENT DOCUMENTS

CN 101046668 10/2007
JP 61-262774 A 11/1986

(Continued)

OTHER PUBLICATIONS

Office Action (Notification of Reasons for Refusal) dated Mar. 27, 2012, issued in corresponding Japanese Patent Application No. 2010-121581, and an English Translation thereof (with Verification of Translation). (5 pages).

(Continued)

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

The present invention provides a fixing device that can interrupt power supply to the resistive heat layer more reliably than the conventional technology, for example, at occurrence of abnormality. Electrodes 52*a* and 52*b* are provided on a circumferential surface of a fixing roller that includes a resistive heat layer that generates heat by receiving power supply, and power is supplied to the resistive heat layer when power supplying electrodes 54*a* and 54*b* that are electrically connected to an electric power source 55 are slidingly in contact with the electrodes 52*a* and 52*b*. An insulating tape 522*a* is attached on the electrode 52*a*, and the drive controller 59 rotates a motor 58 until the electrode 52*a* and the insulating tape 522*a* are in contact with each other, so that power supply to the resistive heat layer is interrupted.

21 Claims, 8 Drawing Sheets

(56) References Cited

U.S. PATENT DOCUMENTS

| | | | | |
|---|---|---|---|---|
| 7,720,420 | B2 * | 5/2010 | Kajita | 399/320 |
| 2004/0218950 | A1 * | 11/2004 | Gogate et al. | 399/329 |
| 2007/0122170 | A1 | 5/2007 | Mashiba | |
| 2007/0230982 | A1 | 10/2007 | Hori et al. | |
| 2011/0069985 | A1 * | 3/2011 | Mizumo | 399/69 |

FOREIGN PATENT DOCUMENTS

| | | | |
|---|---|---|---|
| JP | 6-051668 | A | 2/1994 |
| JP | 09-034295 | A | 2/1997 |
| JP | 10-213983 | A | 8/1998 |
| JP | 2004-170770 | A | 6/2004 |
| JP | 2007-147993 | A | 6/2007 |
| JP | 2009-109997 | A | 5/2009 |

OTHER PUBLICATIONS

Office Action issued in corresponding Chinese Patent Application No. 201110149810.X, dated May 30, 2013, and English translation thereof.

* cited by examiner

FIXING DEVICE, IMAGE FORMING APPARATUS AND HEAT GENERATING ROTATIONAL BODY

This application is based on an application No. 2010-121581 filed in Japan, the contents of which are hereby incorporated by reference.

BACKGROUND OF THE INVENTION (1) Field of the Invention

The present invention relates to a fixing device and in particular to a technology for managing a temperature of a heat generating rotational body.

(2) Description of the Related Art

In recent years, there has been proposed a fixing device that thermally fixes an unfixed toner image that has been formed on a sheet-like transfer material such as copy papers and OHP sheets and has a resistive heat layer included in a heat generating rotational body. In particular, such a fixing device has the resistive heat layer in a fixing belt, and performs fixing by directly supplying power to the resistive heat layer and causing the resistive heat layer to generate Joule heat (see Patent Literature 1). Such a fixing device has very high heat efficiency, since the fixing belt has low heat capacity and a distance from the resistive heat layer that is a heat source to the sheet-like transfer material that is a heated object is short. Therefore, it is possible to realize short warm-up and reduction in power consumption.

On the other hand, since the low heat capacity causes a temperature of the fixing belt to rise rapidly during heat generation, temperature management of the fixing belt is important. When a temperature of the fixing belt is out of a predetermined temperature range and in particular greater than a predetermined upper temperature limit, power supply to the resistive heat layer must be interrupted instantly. Otherwise, the temperature that is greater than the predetermined upper temperature limit is maintained or further increases in a short period, and accordingly a disadvantage such as breakdown of the apparatus might occur.

Conventionally, further temperature increase of the resistive heat layer has been prevented as follows. A surface temperature of the fixing belt is constantly measured, and when the measured surface temperature exceeds a predetermined value, a mechanical switch connected to a power supply circuit is turned off to interrupt power supply to the resistive heat layer.

However, high current is required to heat the resistive heat layer pertaining to the fixing belt, and the high current also flows through the mechanical switch. Accordingly, the high current might cause melting of the mechanical switch. During a normal operation, the mechanical switch is kept on. Accordingly, when melting occurs, the mechanical switch remains on. Therefore, there occurs a problem that, when a temperature of the fixing belt is out of the predetermined temperature range, it is impossible to turn the mechanical switch off to interrupt power supply to the resistive heat layer.

[Patent Literature 1] Japanese Patent Application Publication No. 2009-109997

SUMMARY OF THE INVENTION

In view of the above problem, the present invention aims to provide a fixing device that can interrupt power supply to the resistive heat layer more reliably than the conventional technology, for example, at occurrence of abnormality.

In order to solve the above problem, the present invention is a fixing device that includes (i) a heat generating rotational body that includes a resistive heat layer that generates heat by receiving power supply and (ii) a pressing rotational body, forms a fixing nip by pressing the pressing rotational body against an outer circumferential surface of the heat generating rotational body, and feeds a sheet on which an unfixed image is formed through the fixing nip to thermally fix the image, the fixing device comprising: a power non-receiver that is provided on a part of at least one of outer circumferential regions on respective edge portions of the heat generating rotational body, the outer circumferential regions being other than a sheet passing region of the heat generating rotational body; power receivers that are provided on the respective outer circumferential regions excluding the part on which the power non-receiver is provided; a driver configured to rotate the heat generating rotational body; power feeding members that are in contact with and supply power to the respective power receivers; and a controller configured, when a predetermined power interrupting condition is satisfied, to cause the driver to rotate the heat generating rotational body until the power non-receiver faces at least one of the power feeding members so that the power supply to the heat generating rotational body is interrupted.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

An embodiment of the present invention is described below with reference to the drawings.

1. Structure 1.1 Overall Structure

Figure 1:
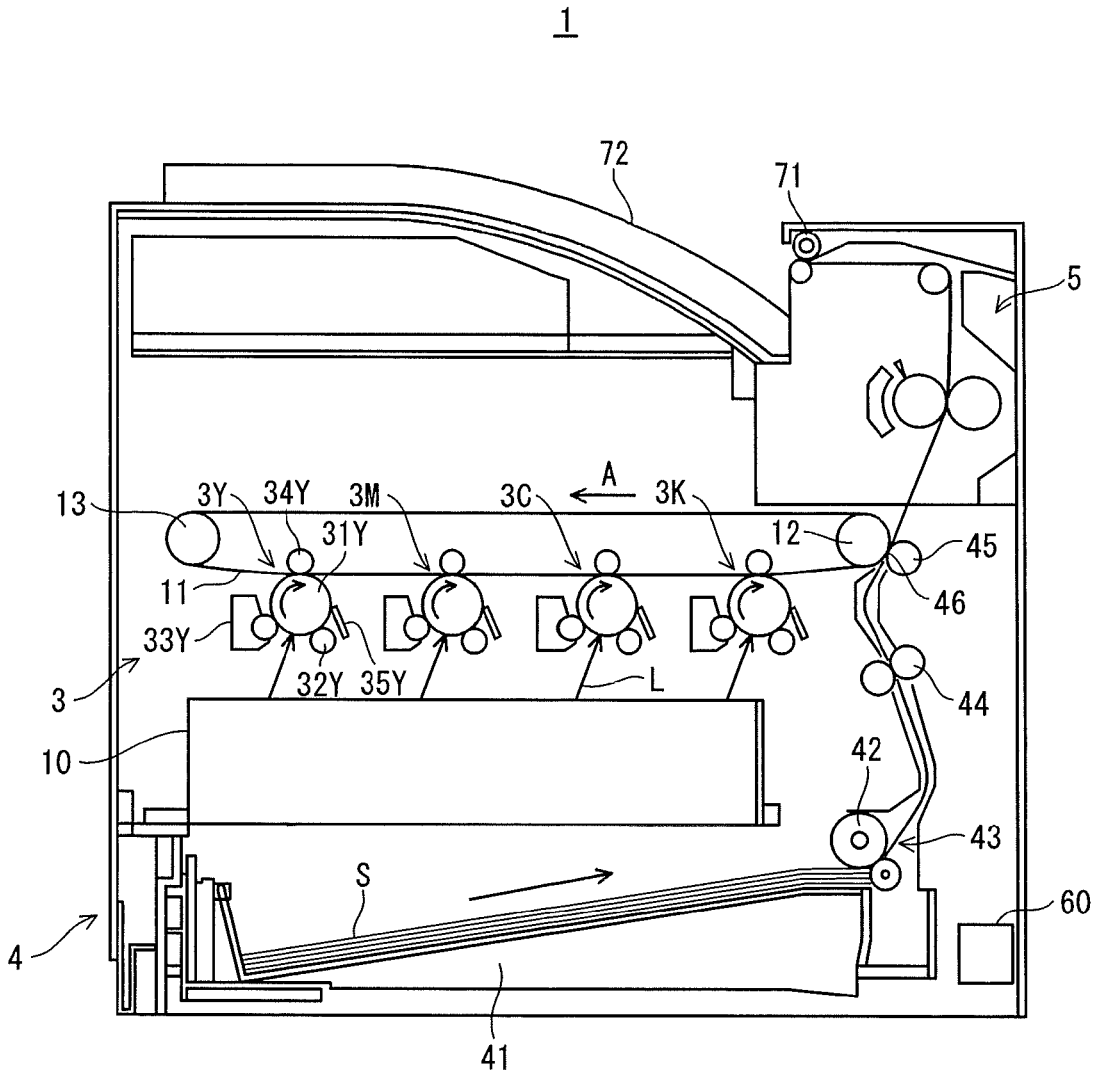
FIG. 1 is a schematic cross-sectional view of an overall structure of a printer pertaining to an embodiment of the present invention.

FIG. 1 is a schematic cross-sectional view of an overall structure of a printer 1 as an image forming apparatus.

As shown in FIG. 1, the printer 1 includes an image processing unit 3, a paper feeder 4, a fixing unit 5 and a control unit 60. The printer 1 is connected to a network (for example, LAN), and upon receiving a print job execution instruction from an external terminal apparatus (not illustrated), executes full-color toner image formation in accordance with the instruction, the full-color toner image being composed of colors yellow, magenta, cyan, and black. The yellow, magenta, cyan and black reproduction colors are hereinafter represented as Y, M, C, and K, respectively, and the letters Y, M, C, and K are appended to reference numbers of constituent elements pertaining to the reproduction colors.

The image processing unit 3 includes image forming units 3Y, 3M, 3C, and 3K corresponding to the colors Y to K, respectively, an optical unit 10, an intermediate transfer belt 11, and the like.

The image forming unit 3Y includes a photosensitive drum 31Y, and in vicinity thereof, includes a charger 32Y, a developer 33Y, a primary transfer roller 34Y, a cleaner 35Y for cleaning the photosensitive drum 31Y, and the like, and forms a toner image in the color of Y on the photosensitive drum 31Y. The other image forming units 3M to 3K also have a similar structure to the image forming unit 3Y, and reference numbers thereof are omitted in FIG. 1.

The intermediate transfer belt 11 is an endless belt that is suspended in a tensioned state on a driving roller 12 and a driven roller 13, and is rotated in the direction of arrow A.

The optical unit 10 includes a light emitting element such as a laser diode, emits a laser beam L by receiving a driving signal generated by the control unit 60 for forming an image in the colors of Y-K, and performs exposure scanning on the photosensitive drums 31Y to 31K.

This exposure scanning forms electrostatic latent images on the photosensitive drums 31Y to 31K charged by the chargers 32Y to 32K. The electrostatic latent images are developed by the developers 33Y to 33K. Consequently, toner images in the colors of Y-K are formed on the photosensitive drums 31Y to 31K, and the image forming operation for each color is executed at different timings so that the toner images are primarily transferred on the same position on the intermediate transfer belt 11.

The toner image in each color is collectively transferred onto the intermediate transfer belt 11 by electrostatic force acting among primary transfer rollers 34Y to 34K to form a full color toner image. The formed image is transported to the secondary transfer position 46.

The paper feeder 4 includes: a paper feeding cassette 41 accommodating recording sheets S; a feeding roller 42 that feeds the recording sheets S from the paper feeding cassette 41 one sheet at a time toward a convey path 43; timing roller pair 44 for determining the timing to send the fed recording sheet S to the secondary transfer position 46; and the like. The recording sheet S is fed from the paper feeder 4 in accordance with the timing of the transportation of the toner image formed on the intermediate transfer belt 11 to the secondary transfer position, and the toner image formed on the intermediate transfer belt 11 is collectively and secondarily transferred onto the recording sheet S by an effect of a secondary transfer roller 45.

The recording sheet S that has passed the secondary transfer position 46 is conveyed to the fixing unit 5, and the toner image (unfixed image) on the recording sheet S is fixed thereto by heat and pressure by the fixing unit 5. After that, the recording sheet S is ejected to an ejected-sheet tray 72 via an ejecting roller pair 71.

Up to this point, the overall structure has been explained. The following explains in detail the fixing unit 5 that is central to the present embodiment.

1.2 Structure of Fixing Unit 5

Figure 2:
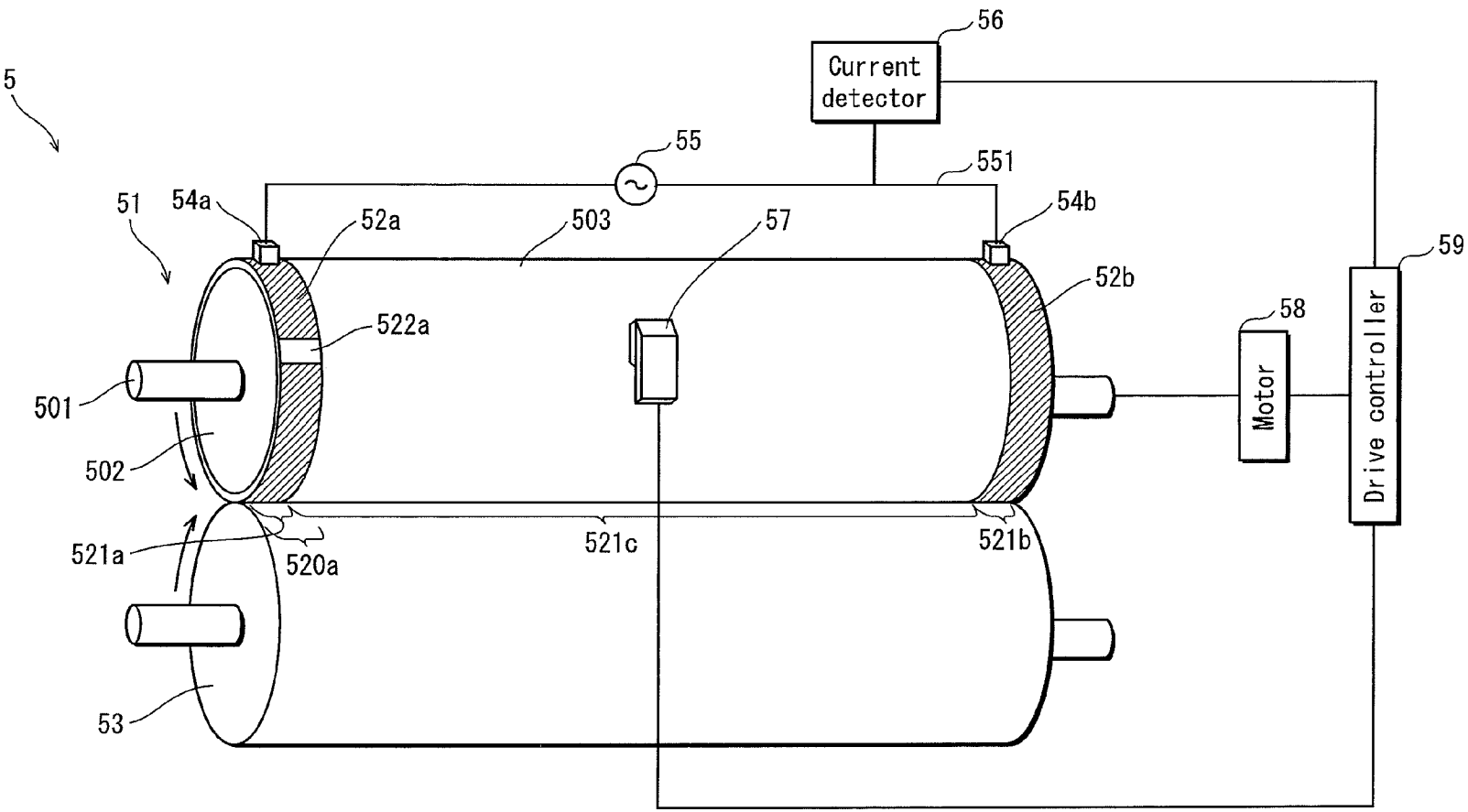
FIG. 2 is a perspective view of a schematic structure of a fixing unit pertaining to the embodiment of the present invention.

FIG. 2 is a perspective view of a schematic structure of the fixing unit 5 of the present embodiment.

The fixing unit 5 includes a fixing roller 51 as a heat generating rotational body, electrodes 52 (52*a*, 52*b*) arranged at respective edges of the fixing roller 51 along an outer circumferential surface thereof, a pressure roller 53 as a pressing rotational body, power feeding members 54 (54*a*, 54*b*) supplying power to the fixing roller 51 for heat generation via the electrodes 52 by sliding contact with the electrodes 52, an electric power source 55 supplying power to the power feeding members 54, a current detector 56 detecting current that flows through a conducting wire 551 between the power feeding members 54 and the electric power source 55, a thermistor 57 that measures surface temperature of the fixing roller 51, a motor 58 as a driving unit rotating the fixing roller 51 and a drive controller 59 controlling rotation (rotational speed, rotational direction and the like) of the motor 58 based on current detected by the current detector 56.

The fixing roller 51 is formed by covering a metal core 501 having an elongated and columnar shape with an elastic material layer 502, and fitting the fixing belt 503 that is an endless belt such that an inner circumferential surface of the fixing belt 503 is in contact with an outer circumferential surface of the elastic material layer 502.

Respective edge portions (521*a* and 521*b*) of an outer circumferential surface of the fixing belt 503 other than a sheet passing region include the electrodes 52 (52*a* and 52*b*) that are approximately 10 mm in width (i.e., in length in an axial direction of the roller) along an entire circumference (for example, approximately 90 mm) in a circumferential direction of the fixing belt 503. Here, the electrode 52*a* includes an insulated portion as a power non-receiver at a part thereof in the circumferential direction. In the present embodiment, the insulated portion is a part to which an insulating tape 522*a* is attached on the electrode 52*a*. A size of the insulated portion is, for example, approximately 10 mm×10 mm. Here, a portion of the electrode other than the insulated portion is referred to as a power receiver. The power receiver and the power non-receiver are aligned.

When the fixing roller 51 is rotated and then the insulating tape 522*a* comes in contact with a contact surface of the power feeding member 54*a*, current does not flow through the fixing roller 51, and accordingly power supply to the fixing roller 51 stops. A size of the contact surface of the power feeding member 54*a* is, for example, approximately 5 mm×5 mm. That is, the power non-receiver is larger than the contact surface of the power feeding member 54*a*. Also, the power non-receiver is at least wider than the power receiver in a direction perpendicular to the circumferential direction of the power receiver. In addition, in the present embodiment, the electrode 52*b* does not include an insulated portion.

Figure 3A:
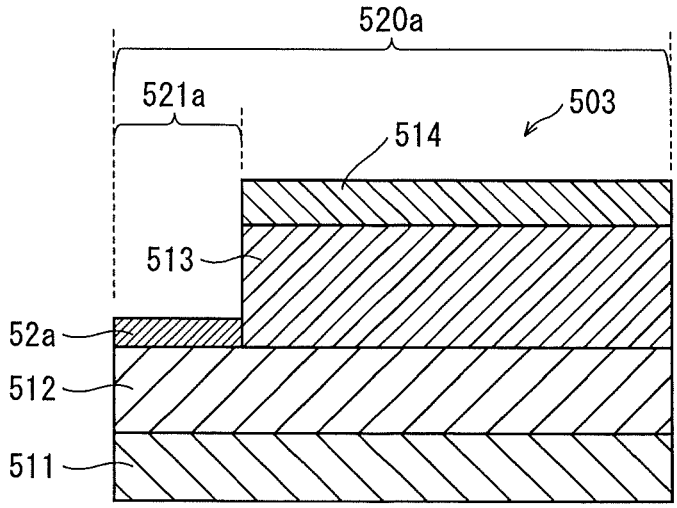
FIG. 3A is a schematic cross-sectional view of an edge portion of a fixing belt of the embodiment of the present invention.

FIG. 3A is a schematic cross-sectional view of an edge portion 520*a* of the fixing belt 503 in a rotational axis direction shown in FIG. 2 (the edge portion 521*a* is included).

A part (center part 521*c*) of the fixing belt 503 excluding the edge portions 521*a* and 521*b* is formed by layering an insulating layer 511, a resistive heat layer 512, an elastic layer 513, and a release layer 514 in this order from the inside.

The insulating layer 511 is made of heat resistant resin such as PI (Polyimide), PPS (Polyphenylene sulfide), and PEEK (Polyether ether ketone), and a thickness of the insulating layer 511 is, for example, approximately 5-100 μm.

The resistive heat layer 512 generates heat by current supply, and is formed by dispersing conductive filler in heat resistant resin such as PI, PPS, and PEEK. As conductive filler, metal such as Ag, Cu, Al, Mg and Ni or carbon filler such as carbon nano tube, carbon nano fiber, and carbon micro coil is used. Two or more of them may be mixed for use. A thickness of the resistive heat layer 512 is, for example, preferably approximately 5-100 μm.

The elastic layer 513 is made of a heat resistant material such as silicone rubber and fluoro rubber, and a thickness of the elastic layer 513 is, for example, approximately 100-300 μm.

The release layer 514 is formed by coating fluoro resin having high releasability such as PFA (Perfluoroalkoxy), PTFE (Polytetrafluoroethylene), and ETFE (Ethylene-tetra fluoro ethylene) on a surface of the elastic layer 513. Also, a tube made of such resin may be used. A thickness of the release layer 514 is, for example, approximately 5-100 μm.

On the other hand, the edge portion 521*a* of the fixing belt 503 has the insulating layer 511 and the resistive heat layer 512 like the center part 521*c*, but unlike the center part 521*c*, the elastic layer 513 and the release layer 514 are not layered on the resistive heat layer 512, and the electrode 52*a* is formed by plating.

Figure 3B:
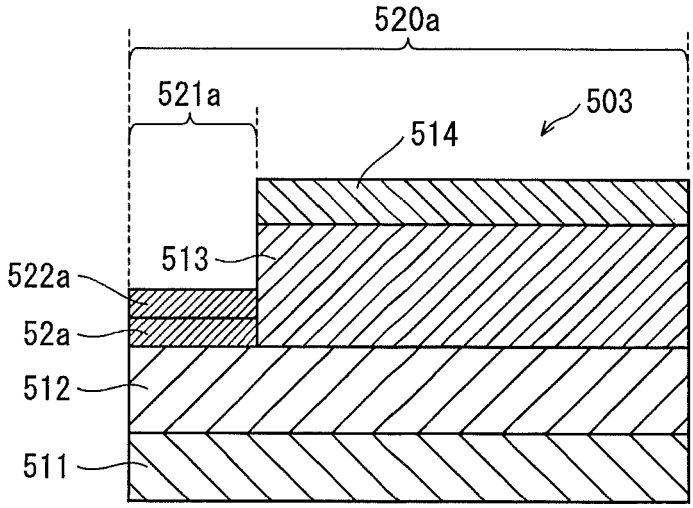
FIG. 3B is a schematic cross-sectional view of a part of the edge portion of the fixing belt, to which an insulating tape is attached.

FIG. 3B is a schematic cross-sectional view of a part of the edge portion 520*a* of the fixing belt 503, to which the insulating tape 522*a* is attached. As FIG. 3B shows, the insulating tape 522*a* is attached on the electrode 52*a* so that the electrode 52*a* is covered.

Each of the power feeding members 54 is, for example, a rectangular solid block that is approximately 5 mm quadrilateral in size, and a so-called carbon brush made of a material such as copper graphite and carbon graphite having slidability and conductivity.

The power feeding members 54 are conducted with the electric power source 55 through the conducting wire 551. Also, each of the power feeding members 54 is pressed against a corresponding one of the electrodes 52 by an elastic member (not illustrated) made of a spring, for example. Each of the power feeding members 54 is energized to push the corresponding one of the electrodes 52 in a center direction of the rotational axis of the fixing roller 51, and the energizing power causes each of the power feeding members 54 to be pressed against the corresponding one of the electrodes 52. Each of the power feeding members 54 receives stress generated by stiffness of the fixing belt 503 in an opposite direction of the above-mentioned energizing power from the fixing belt 503, and thereby each of the power feeding members 54 and the corresponding one of the electrodes 52 are kept in contact with each other. Hereinafter, a surface of one of the power feeding members 54 that is slidingly in contact with the corresponding one of the electrodes 52 or the insulating tape 522*a* is referred to as a contact surface.

It has been described in the present embodiment that each of the power feeding members 54 receives the stress generated by the stiffness of the fixing belt 503. However, stress may be generated by a backing material (elastic roller may be substituted) provided inside the fixing belt 503, for example.

The electric power source 55 supplies power to the resistive heat layer 512 through the conducting wire 551, the power feeding members 54, and the electrodes 52.

The current detector 56 detects current that flows through the conducting wire 551 and constantly notifies the drive controller 59 of information (current information) pertaining to the detected current. In the present embodiment, the current information indicates whether the current detector 56 is detecting current (on-state) or not detecting current (off-state). Note that, the current information is not limited to this. The current information has only to indicate a state of the current detected by the current detector 56, for example, like a current value of the current detected by the current detector 56.

The thermister 57 is a temperature sensor to measure a surface temperature of the fixing roller 51, and constantly notifies the drive controller 59 of the measured temperature.

The motor 58 can control a rotational direction (clockwise direction, counterclockwise direction) and a rotational speed of the axis.

In the present embodiment, the rotational frequency of the axis of the motor 58 is determined by control voltage applied to the motor 58, and the rotational direction of the axis is determined by polarity of the control voltage, but the frequency and the direction are not limited to them. The axis of the motor 58 is connected to an axis (metal core 501) of the fixing roller 51, and the fixing roller 51 rotates in conjunction of the rotation of the axis of the motor 58.

The drive controller 59 has a clock function, and controls rotation of the motor 58, that is, rotation of the fixing roller 51, by controlling amplitude, polarity and an applied time of the control voltage applied to the motor 58. The drive controller 59 uses the current information constantly received from the current detector 56 and the measured temperature value constantly received from the thermister 57 to determine rotational direction (polarity of the control voltage), rotational speed (amplitude of the control voltage), and a rotation duration time (applied time of the control voltage) of the motor 58 (fixing roller 51), and applies the control voltage to the motor 58.

1.3. Control of Motor 58 by Drive Controller 59

The following explains control of the motor 58 by the drive controller 59.

1.3.1. Current Information Received by Drive Controller 59 from Current Detector 56.

Firstly, current information received by the drive controller 59 will be explained.

Figure 4:
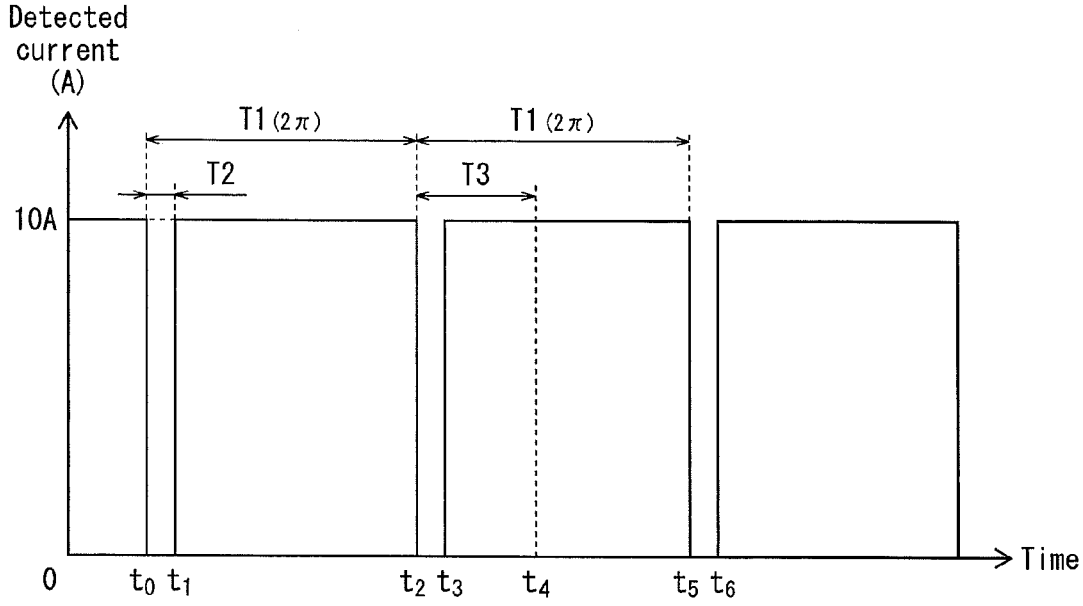
FIG. 4 shows an example of a current waveform measured by a current detector while a motor pertaining to the embodiment of the present invention rotates at a constant speed.

FIG. 4 shows an example of a current waveform measured by the current detector 56 while the motor 58 rotates at a constant speed by a normal operation.

The current detector 56 measures a current waveform, in which a state where a current value is not detected (off-state) (T2) and a state where 10 A (ampere) current is detected (on-state) (T1–T2) appear repeatedly in a period T1.

The period T1 indicates a period required for one rotation of the axis of the motor 58.

The period T2 indicates a period during which the contact surface of the power feeding member 54*a* is in overall contact with the insulating tape 522*a*, and out of contact with the electrode 52*a*.

Here, regarding rotation of the motor, when the motor rotates in a predetermined direction (clockwise direction), a rotation reference position (where rotational angle is 0 degree) is defined as follows: a position at which a state where a part of the contact surface of the power feeding member 54*a* is in contact with the electrode 52*a* (on-state) changes to a state where the contact surface of the power feeding member 54*a* is in overall contact with the insulating tape 522*a* and out of contact with the electrode 52*a* (off-state). Also, a rotation reference time is defined as a time at the rotation reference position. The axis of the motor 58 is positioned at the rotation reference position in cycles of T1 period, and reaches the rotation reference time at intervals of the T1 period.

The rotation reference position is a rotational position at commencement of period T2, that is, a time (such as time t0 and t2 in FIG. 4) when fall edge indicating the detected current changes from 10 A to 0 A is detected.

The current detector 56 constantly compares a current value of the detected current and a threshold value (for example, 5 A). If the detected current value is equal to or greater than the threshold value, the current information indicating the on-state is notified to the drive controller 59, and if the detected current value is smaller than the threshold value, the current information indicating the off-state is notified to the drive controller 59. Alternatively, the current detector 56 may notify the drive controller 59 of a current value of the detected current waveform, instead of the current information indicating the on-state or the off-state. In this case, the drive controller 59 compares the received current value with the threshold value and determines the on-state/off-state, as described above.

1.3.2. Control of Motor 58 by Drive Controller 59

The drive controller 59 recognizes a rotational position of the motor, using the current information constantly received.

For example, in the case of receiving the current information based on the current waveform in FIG. 4, the drive controller 59 recognizes that a rotational angle of the axis of the motor 58 is 0 degree at a time (t0, t2, and t5) when a state indicated by the current information changes from the on-state to the off-state. Also, the drive controller 59 measures a time period elapsed since the rotational angle was 0 degree, or a time period (cycle T1) that elapses until the rotational angle becomes 0 degree next time, using the above-mentioned clock function.

For example, in the case where it is necessary to calculate a rotational angle X at the time t4, it is shown that a period T3 has elapsed between the time t2 at which the rotational angle is 0 degree and the time t4. Accordingly it is possible to calculate the rotational angle X by the following expression: the rotational angle X (degree)=360×(T3/T1) (degree).

Also, in the case where it is necessary to interrupt power supply to the fixing roller 51 at the time t4, the drive controller 59 calculates a time that elapses until the motor comes to the rotation reference position next by the following expression: (T1−T3). Then, voltage is continuously applied to the motor 58 during a period (T1−T3), and the voltage applied to the motor 58 is stopped when the period (T1−T3) has elapsed. Thereby, the axis of the motor 58 is positioned at the rotation reference position, and electrical connection between the electric power source 55 and the fixing belt 51 is interrupted.

2. Operation

Figure 5:
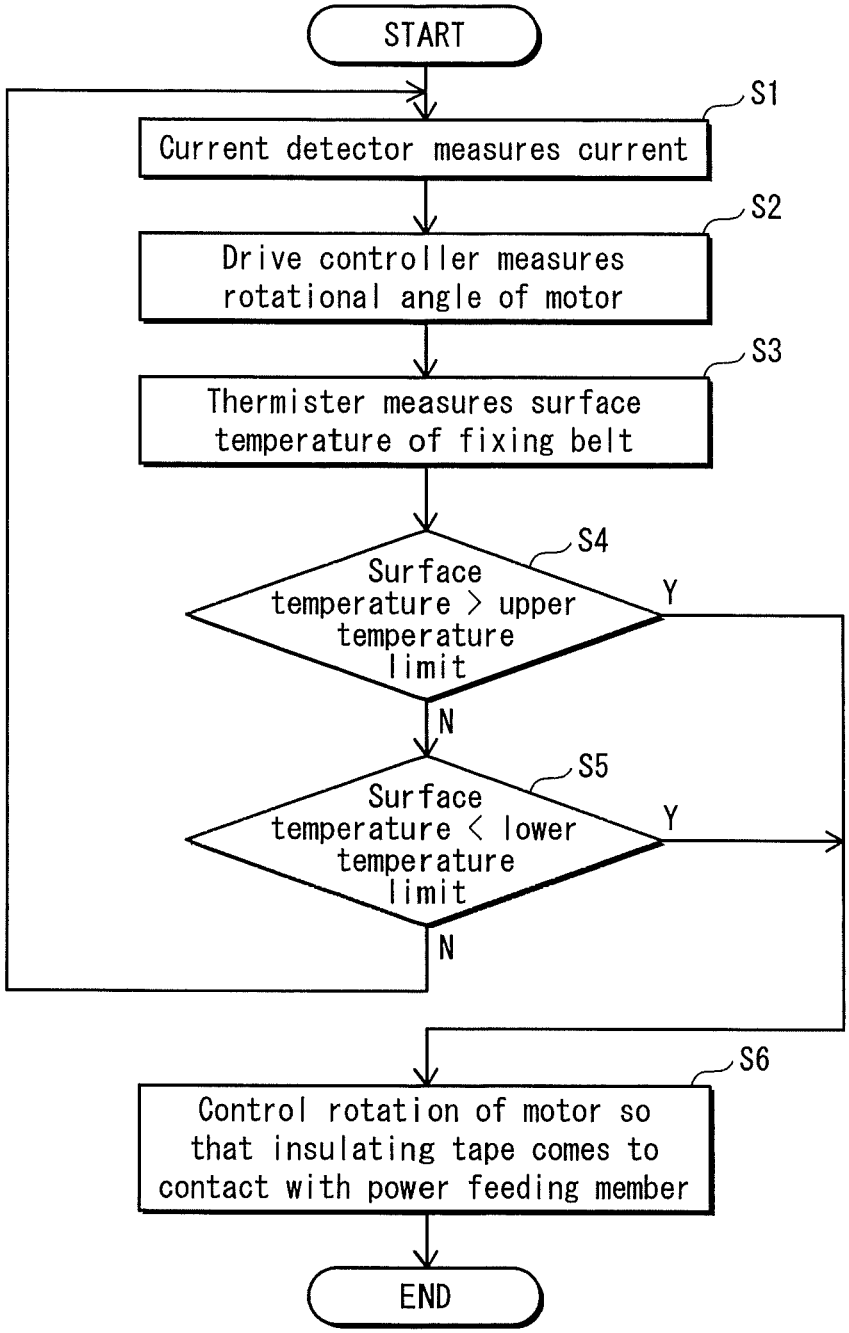
FIG. 5 is a flowchart of a procedure for controlling rotation of the motor pertaining to the embodiment of the present invention.

The following explains temperature control at the fixing belt 503 in the printer 1 with the above-mentioned structure, with reference to FIG. 5.

The current detector 56 detects current at a predetermined interval and notifies the drive controller 59 of the current information indicating either the on-state or the off-state based on the detected current (S1).

The drive controller 59 calculates a time of switching from the on-states to the off-state, a period of the off-state, a rotational cycle, and the like. Also, if necessary, the drive controller 59 calculates a current rotational angle (elapsed time from the rotation reference position) (S2).

Also, the thermister 57 constantly measures a surface temperature of the fixing belt 503, and notifies the drive controller 59 of the measured temperature at predetermined interval.

The drive controller 59 receives the measured temperature of the fixing belt 503 from the thermister 57 (S3).

Then the drive controller 59 judges whether or not the surface temperature of the fixing belt 503 is higher than a predetermined upper temperature limit (250 degrees Celsius) as the power interrupting condition (S4). If the surface temperature is higher than the limit (S4: Y), the drive controller 59 calculates a time period to elapse until the axis of the motor 58 comes to the rotation reference position next so as to interrupt power supply from the electric power source 55 to the fixing roller 51. After the control voltage is applied during the calculated time period, the control voltage is stopped being applied. Thereby, the axis of the motor 58 is positioned at the rotation reference position (S6). Then the contact surface of the power feeding member 54*a* is in overall contact with the insulating tape 522*a*, and accordingly power supply to the resistive heat layer 512 of the fixing belt 503 is interrupted and then heat generation of the resistive heat layer 512 stops. Therefore, a temperature of the resistive heat layer 512 decreases. Thereby, the temperature of the resistive heat layer 512, which is greater than the upper temperature limit, can be reduced to a temperature that is lower than the upper temperature limit.

Also, if the surface temperature is equal to or lower than the upper temperature limit (S4: N), whether or not the surface temperature is lower than a predetermined lower temperature limit is judged (S5). If the surface temperature is not lower than the lower temperature limit (S5: N), the procedure proceeds to Step S1, and if the surface temperature is lower than the lower temperature limit (S5: Y), the procedure proceeds to Step S6.

In addition, judgment of Step S5 is not performed until a predetermined time elapses since the printer 1 was connected to the electric power source and power supply to the resistive heat layer 512 was also started. This is because, immediately after the printer 1 is connected to the electric power source and power supply to the resistive heat layer 512 of the fixing belt 503 is started, the temperature is generally lower than the lower temperature limit (S5: Y). Also, if the temperature is not greater than the lower temperature limit after the predetermined period, it is thought that some kind of trouble has occurred.

Up to this point, the operation has been explained.

Though FIG. 5 expresses that Steps S1, S2, and S3 are sequentially performed, Steps S1, S2, and S3 may be performed at any time in parallel. Also, though the procedure is supposed to end at Step S6, if the temperature is higher than the upper temperature limit at Step S4 (S4: Y), the axis of the motor 58 may be controlled to be positioned at the rotation reference position and power supply to the resistive heat layer 512 may be interrupted. After the temperature of the resistive heat layer 512 is lower than the upper temperature limit, the procedure may start from Step S1, on the assumption that the state has returned to normal. Also, if the temperature is lower than the lower temperature limit at Step S5 (S5: Y), the procedure may not proceed to Step S6, and power supply to the resistive heat layer 512 may continue so as to increase the temperature.

As explained above, according to the embodiment of the present invention, when it is necessary to stop heat generation of the resistive heat layer 512, power supply to the resistive heat layer 512 of the fixing belt 503 is interrupted by causing the contact surface of the power feeding member 54*a* to be overall contact with the insulating tape 522*a*. Accordingly, since a mechanical switch is not used, the conventional problem that melting of the mechanical switch occurs and then heat generation of the resistive heat layer 512 cannot be stopped does not occur. It is therefore possible to stop heat generation of the resistive heat layer 512 more reliably compared with the conventional technology.

3. Modifications and Others

In addition, the fixing device of the present invention is not limited to the above-mentioned illustrated example. It is surely possible to make various modifications without departing from the scope of the present invention.

(1) The above-mentioned embodiment has explained the example in which the insulating tape 522*a* is attached on the electrode 52*a* as the insulated portion (power non-receiver). However, an insulated portion is not limited to this, and there has only to be an insulated portion.

For example, an insulated portion may be formed on the electrode 52*a* by removing a part that corresponds to the insulating tape 522*a* in the above-mentioned embodiment. In this case, the insulated portion can be formed by cutting off a part of the electrode, or by not forming an electrode from the very first at a part that corresponds to the cut off part. Accordingly, other materials such as an insulating material are not needed.

In this case, the resistive heat layer 512 per se is expected to be removed. This is because, if the resistive heat layer 512 is not removed, the power feeding member 54*a* is directly contact with the resistive heat layer 512 by the energizing power and power is supplied to the resistive heat layer 512. Besides, an insulating layer and a conductive layer may be formed in different areas by a print technology. In this case, an insulated portion can be formed by a simple structure of covering a part of the electrode with the insulator.

Figure 6:
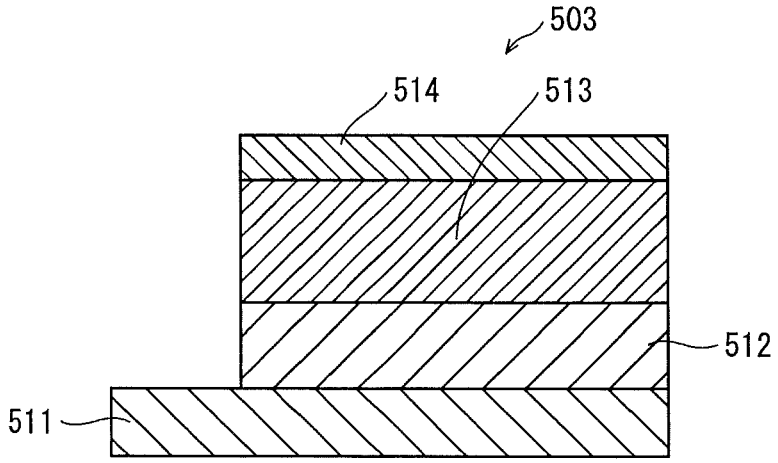
FIG. 6 is a schematic cross-sectional view of an edge portion of a fixing belt pertaining to a modification.

FIG. 6 shows a cross-section of a part of the edge portion 520*a* of the fixing belt 503 pertaining to the present modification, at which an insulated portion is provided.

FIG. 6 corresponds to above described FIG. 3A that does not include the electrode 52*a* and the resistive heat layer 512 on the edge portion 521*a*.

Figure 7A:
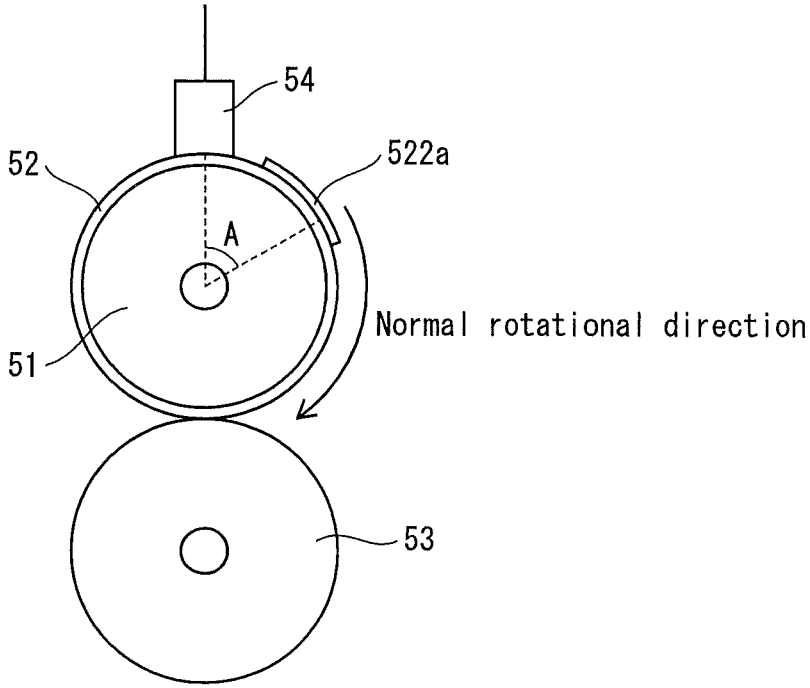
FIGS. 7A and 7B are each a view for explaining a rotational direction of a fixing roller pertaining to the modification.

(2) In the above embodiment, when the axis of the motor 38 is set to be positioned at the rotation reference position, the axis of the motor is rotated in the clockwise direction (rotational direction for conveying sheets, FIG. 7A), but the direction is not limited to this.

Figure 7B:
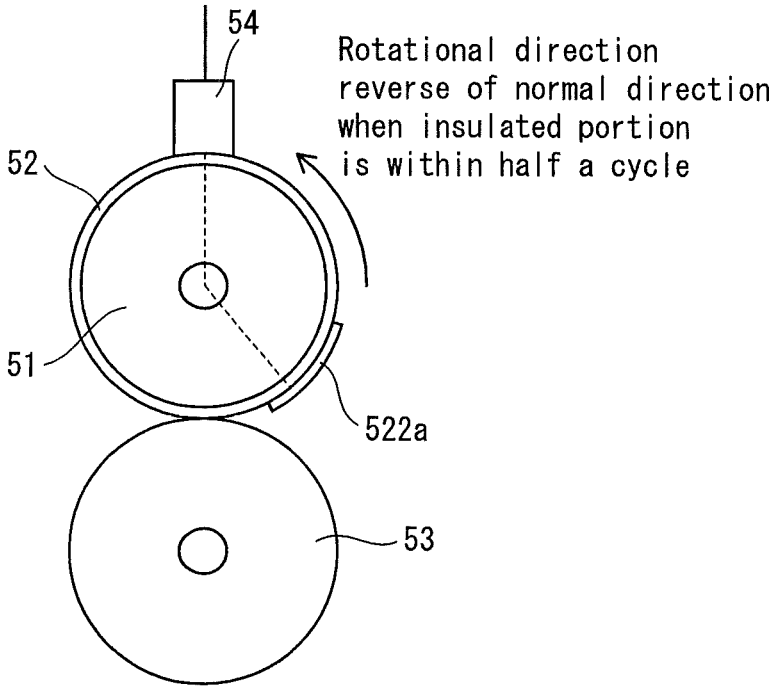

For example, if the insulated portion is positioned within half a circle (180 degrees of the rotational angle) from the power feeding member 54*a* in the clockwise direction, it is possible to rotate the fixing roller 51 in a counterclockwise direction and cause the contact surface of the power feeding member 54*a* to entirely and slidingly contact with the insulated portion faster than rotating the fixing roller 51 in the clockwise direction so as to interrupt power supply to the resistive heat layer 512 (FIG. 7B).

Figure 8:
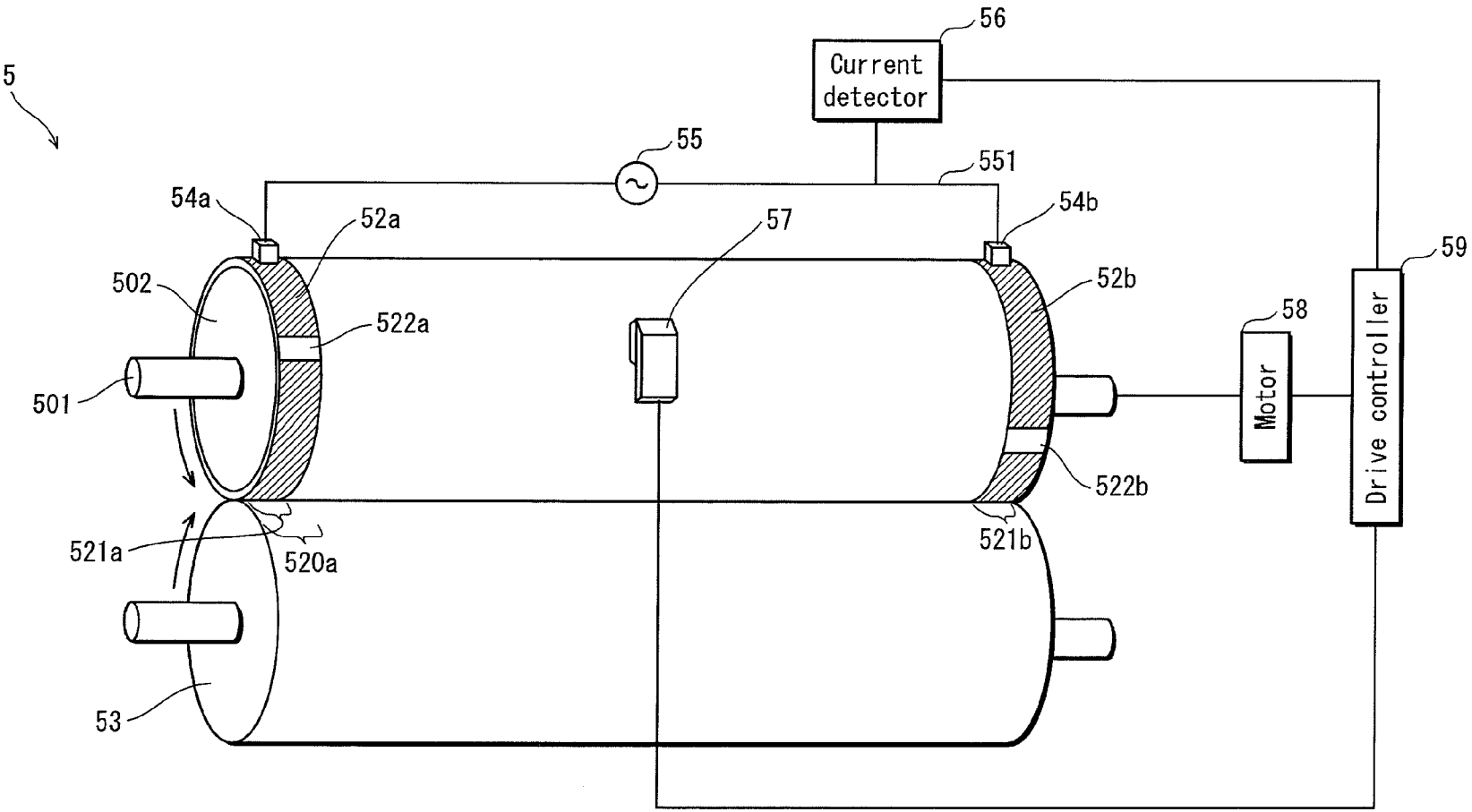
FIG. 8 is a perspective view of a schematic structure of a fixing unit pertaining to the modification.

(3) In the above embodiment, the insulating tape 522*a* is attached to the single part of the electrode 52*a*, but not limited to this. For example, an insulating tape (522*b*) may be attached to the electrode 52*b* in the same way (FIG. 8).

In this case, preferably, both insulating tapes are not positioned at corresponding positions. For example, both insulating tapes are arranged as follows: when one of the insulating tapes (for example, the insulating tape 522*a*) is in contact with a corresponding electrode (for example, the electrode 52*a*), the other insulating tape (for example, the insulating tape 522*b*) is separated from the electrode 52*b* by 180 degrees in terms of the rotational angle.

Then, as explained in the above embodiment, the drive controller 59 can recognize positional relationship between the insulating tape 522*a* and the power feeding member 54*a* using the current information constantly received. It is therefore possible to recognize positional relationship between the insulating tape 522*b* separated from the insulating tape 522*a* by 180 degrees in terms of the rotational angle and the corresponding power feeding member 54*b*. Then, when power supply to the resistive heat layer 512 needs to be interrupted, it is possible to interrupt power supply to the resistive heat layer 512 faster, by rotating the motor 58 to cause one of the insulating tapes 522*a* and 522*b*, which is nearer to the corresponding power feeding members 54*a* or 54*b*, to come to contact with the corresponding power feeding member.

Also, more than two insulating tapes may be attached to the electrodes 52.

In this case, in terms of the rotational angle of the motor 58, the more than two insulating tapes are preferably positioned at equal intervals (equal rotational angles).

(4) In the above embodiment, the motor 58 is explained as a DC motor and the like. However, other motors such as a stepping motor that can control the rotational angle more accurately by the number of drive pulses may be used. In this case, a process such as calculation of the rotational angle of the motor based on the current detected by the current detector 56 is unnecessary.

(5) In the above embodiment, as the predetermined power interrupting condition, when the surface temperature of the fixing belt 503 detected by the thermister 57 is out of the predetermined temperature range, power supply to the resistive heat layer 512 is interrupted. But the predetermined power interrupting condition is not limited to this. Power supply to the resistive heat layer 512 may be interrupted in other cases.

For example, the printer 1 includes a component such as a sensor for detecting that an openable cover for releasing a trouble or abnormal condition is opened or an openable cover for replacing a toner cartridge or supplying sheets is opened, and when the sensor makes detection, an instruction to interrupt power is transmitted to the drive controller 59. When receiving the instruction to interrupt power, the drive controller 59 interrupts power supply to the resistive heat layer 512.

Thereby, it is possible to prevent beforehand accidents such as a burn, which occurs when the cover of the printer 1 is opened and a user touches an abnormally high temperature part and the like.

(6) The motor 58 can control rotational speed by voltage that is a control signal from outside. Usually, a voltage value of the control signal is set such that the rotational speed is in view of fixity of the sheet. However, when power supply to the resistive heat layer 512 is interrupted, the voltage value of the control signal may be larger than usual to rotate the motor faster than normal speed.

Thereby, a period before power supply to the resistive heat layer 512 is interrupted can be reduced.

(7) In the above embodiment, the electrodes 52 are provided on the outer circumferential surface of the fixing belt 503, and the power feeding members 54 are pressed against the corresponding electrodes 52 from the outer circumferential surface of the fixing belt 503. However, this is not limited to this. The electrodes 52 may be provided on an inner circumferential surface of the fixing belt 503, and the power feeding members 54 may be positioned inside the fixing belt 503 and pressed against the corresponding electrodes 52 from inside of the fixing belt 503.

(8) In the above embodiment, the fixing belt 503 is set such that an inner circumferential surface of the fixing belt 503 is in contact with the outer circumferential surface of the elastic material layer 502, but not limited to this. The following structure (so-called loose-fit structure) may be used: an outside diameter of the elastic material layer 502 may be smaller than an inside diameter of the fixing belt 503, the elastic material layer 502 and the fixing belt 503 may be in contact with each other at the fixing nip, and there may be a gap (space) therebetween at other parts except for the fixing nip.

(9) Specific values in the above embodiment are examples, and not limited to them,

(10) The present invention is not limited to a tandem type color digital printer, and applied to all image forming apparatuses including a fixing device, such as a black-and-white copier, a printer, a facsimile and a Multifunction Peripheral (MFP) having these functions.

(11) It should be noted that the above-described embodiment and modifications may be combined.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device that includes (i) a heat generating rotational body that includes a resistive heat layer that generates heat by receiving power supply and (ii) a pressing rotational body, forms a fixing nip by pressing the pressing rotational body against an outer circumferential surface of the heat generating rotational body, and feeds a sheet on which an unfixed image is formed through the fixing nip to thermally fix the image, the fixing device comprising:

a power non-receiver that is provided on a part of at least one of outer circumferential regions on respective edge portions of the heat generating rotational body, the outer circumferential regions being other than a sheet passing region of the heat generating rotational body;

power receivers that are provided on the respective outer circumferential regions excluding the part on which the power non-receiver is provided;

a driver configured to rotate the heat generating rotational body;

power feeding members that are in contact with and supply power to the respective power receivers; and a controller configured, when a predetermined power interrupting condition is satisfied, to cause the driver to rotate the heat generating rotational body until the power non-receiver faces at least one of the power feeding members so that the power supply to the heat generating rotational body is interrupted.

2. The fixing device of claim 1, wherein the power non-receiver and at least one of the power receivers are aligned in a circumferential direction of the outer circumferential regions.

3. The fixing device of claim 1, wherein an outer circumferential surface of the power non-receiver is larger than a contact surface of the at least one of the power feeding members.

4. The fixing device of claim 1, wherein a width of the power non-receiver is equal to or larger than a width of the at least one of the power receivers in a direction perpendicular to a circumferential direction of the at least one of the power receivers.

5. The fixing device of claim 1, wherein an electrode is provided on a whole circumference of each of the outer circumferential regions, the power non-receiver is a part of the electrode provided on the at least one of the outer circumferential regions, the part being covered with an insulating material, and the power receivers are parts of the electrodes provided on the respective outer circumferential regions, the parts not being covered with the insulating material.

6. The fixing device of claim 5, wherein the power non-receiver is a part at which the insulating material is layered.

7. The fixing device of claim 1, wherein the power receivers correspond to parts of the respective outer circumferential regions on which electrodes are provided, and the power non-receiver corresponds to a part of at least one of the outer circumferential regions from which the corresponding electrode is partly removed.

8. The fixing device of claim 1, wherein when the predetermined power interrupting condition is satisfied, the controller interrupts the power supply by causing the driver to rotate the heat generating rotational body in a rotational direction pertaining to a shorter rotational time period among (i) a rotational time period required to interrupt the power supply by rotating the heat generation rotational body in a forward direction and (ii) a rotational time period required to interrupt the power supply by rotating the heat generation rotational body in a direction reverse of the forward direction.

9. The fixing device of claim 1, wherein in order to interrupt the power supply to the heat generating rotational body, the controller causes the driver to rotate the heat generating rotational body faster than a normal rotational speed.

10. The fixing device of claim 1, further comprising a judger configured to constantly judge whether current is flowing through the resistive heat layer, wherein the controller constantly receives a judgment result from the judger to calculate a start point of each cycle during which no current flows, and in order to interrupt the power supply to the heat generating rotational body, the controller calculates a time period that is to elapse until a start point of a next cycle during which no current flows, and stops the driver after causing the driver to rotate the heat generating rotational body for the calculated time period.

11. The fixing device of claim 1, wherein the power non-receiver is provided in a pair, each power non-receiver being provided on a corresponding one of the outer circumferential regions, and when the predetermined power interrupting condition is satisfied, the controller causes the driver to rotate the heat generating rotational body for a shorter rotational time period among (i) a first rotational time period required to rotate the heat generating body until one of the power feeding members faces the corresponding power non-receiver provided on one of the outer circumferential regions and (ii) a second rotational time period required to rotate the heat generating rotational body until another of the power feeding members faces the corresponding power non-receiver provided on another of the outer circumferential regions.

12. The fixing device of claim 1, further comprising:

a measure configured to measure a surface temperature of the heat generating rotational body, wherein when the measured surface temperature is out of a predetermined temperature range, the controller judges that the predetermined power interrupting condition is satisfied.

13. The fixing device of claim 1, wherein when the controller receives an instruction to interrupt the power supply to the resistive heat layer, the controller judges that the predetermined power interrupting condition is satisfied.

14. The fixing device of claim 1, wherein the heat generating rotational body is a fixing belt.

15. An image forming apparatus including a fixing device that includes (i) a heat generating rotational body that includes a resistive heat layer that generates heat by receiving power supply and (ii) a pressing rotational body, forms a fixing nip by pressing the pressing rotational body against an outer circumferential surface of the heat generating rotational body, and feeds a sheet on which an unfixed image is formed through the fixing nip to thermally fix the image, the fixing device comprising:

a power non-receiver that is provided on a part of at least one of outer circumferential regions on respective edge portions of the heat generating rotational body, the outer circumferential regions being other than a sheet passing region of the heat generating rotational body;

power receivers that are provided on the respective outer circumferential regions excluding the part on which the power non-receiver is provided;

a driver configured to rotate the heat generating rotational body;

power feeding members that are in contact with and supply power to the respective power receivers; and a controller configured, when a predetermined power interrupting condition is satisfied, to cause the driver to rotate the heat generating rotational body until the power non-receiver faces at least one of the power feeding members so that the power supply to the heat generating rotational body is interrupted.

16. The image forming apparatus of claim 15, wherein the power non-receiver and at least one of the power receivers are aligned in a circumferential direction of the outer circumferential regions.

17. The image forming apparatus of claim 15, wherein an outer circumferential surface of the power non-receiver is larger than a contact surface of the at least one of the power feeding members.

18. The image forming apparatus of claim 15, wherein a width of the power non-receiver is equal to or larger than a width of the at least one of the power receivers in a direction perpendicular to a circumferential direction of the at least one of the power receivers.

19. The image forming apparatus of claim 15, wherein an electrode is provided on a whole circumference of each of the outer circumferential regions, the power non-receiver is a part of the electrode provided on the at least one of the outer circumferential regions, the part being covered with an insulating material, and the power receivers are parts of the electrodes provided on the respective outer circumferential regions, the parts not being covered with the insulating material.

20. The image forming apparatus of claim 15, wherein the power non-receiver is a part at which the insulating material is layered.

21. The image forming apparatus of claim 15, wherein the power receivers correspond to parts of the respective outer circumferential regions on which electrodes are provided, and the power non-receiver corresponds to a part of at least one of the outer circumferential regions from which the corresponding electrode is partly removed.

* * * * *